US005880458A

United States Patent [19]

Shimoi et al.

[11] Patent Number: 5,880,458

[45] Date of Patent: Mar. 9, 1999

[54] PHOTOMULTIPLIER TUBE WITH FOCUSING ELECTRODE PLATE HAVING FRAME

[75] Inventors: Hideki Shimoi; Hiroyuki Kyushima; Hisaki Katoh, all of Hamamatsu, Japan

[73] Assignee: Hamamatsu Photonics K.K., Hamamatsu, Japan

[21] Appl. No.: 954,964

[22] Filed: Oct. 21, 1997

[51] Int. Cl.[6] ..... H01J 43/04; H01J 43/10; H01J 43/18

[52] U.S. Cl. ..... 250/207; 313/533; 313/103 R; 313/103 CM; 313/105 CM; 313/537; 313/532; 313/541; 313/544; 250/214 VT

[58] Field of Search ..... 250/207, 214 VT, 250/214 LA; 313/105 CM, 103 CM, 105 R, 103 R, 532, 533, 534, 537, 540, 541, 542, 544, 535, 536

[56] References Cited

U.S. PATENT DOCUMENTS

| | | | |
|---|---|---|---|
| 4,881,008 | 11/1989 | Kyushima et al . | |
| 4,937,506 | 6/1990 | Kimura et al. . | |
| 4,999,540 | 3/1991 | L'hermite | 313/103 CM |
| 5,180,943 | 1/1993 | Kyushima . | |
| 5,410,211 | 4/1995 | Kyushima . | |
| 5,491,380 | 2/1996 | Kyushima et al. | 313/103 CM |
| 5,498,926 | 3/1996 | Kyushima et al. | 313/103 CM |
| 5,504,386 | 4/1996 | Kyushima et al. . | |
| 5,532,551 | 7/1996 | Kyushima et al. . | |
| 5,572,089 | 11/1996 | Kyushima et al. | 313/103 CM |
| 5,616,987 | 4/1997 | Ohmura et al. | 313/533 |
| 5,637,959 | 6/1997 | Kyushima et al. | 313/533 |
| 5,689,152 | 11/1997 | Boutot et al. | 313/537 |

FOREIGN PATENT DOCUMENTS

| | | |
|---|---|---|
| 0-622-824 | 4/1994 | European Pat. Off. . |
| A-6-314550 | 11/1994 | Japan . |
| 2 300 513 | 11/1996 | United Kingdom . |

*Primary Examiner*—Edward P. Westin
*Assistant Examiner*—John R. Lee
*Attorney, Agent, or Firm*—Oliff & Berridge, PLC

[57] ABSTRACT

In the photomultiplier tube 1, the focusing electrode plate 17 has the focusing portion 20 for focusing incident electrons and the frame 21 surrounding the focusing portion 20. The focusing portion 20 has a plurality of slit openings 18. The dynode unit 10 is constructed from a plurality of dynode plates 11 laminated one on another. Each dynode plate 11 has a plurality of electron through-holes 13 located in confrontation with the plurality of slit openings 18. A plurality of anodes 9 are provided for receiving electrons emitted from the respective through-holes 13 of the dynode unit 10. The frame 21 has dummy openings 22 at positions located in confrontation with edges 15 of the first stage dynode plate 11*a* in the dynode unit 10.

10 Claims, 8 Drawing Sheets

PHOTOMULTIPLIER TUBE WITH FOCUSING ELECTRODE PLATE HAVING FRAME

BACKGROUND OF THE INVENTION

1. Field of the Invention

The present invention relates to an electron multiplier and a photomultiplier tube, and more particularly relates to an electron multiplier and a photomultiplier tube provided with a focusing electrode plate.

2. Description of Related Art

In a photomultiplier tube disclosed in Japanese Patent Unexamined Patent Application (Kokai) No. 6-314550, a photocathode is formed on the internal surface of a faceplate. A plate-shaped focusing electrode is provided in confrontation with the photocathode. The focusing electrode plate includes a focusing portion having a plurality of openings and a frame portion surrounding the focusing portion.

A block-shaped dynode unit is located below the focusing electrode plate. The dynode unit is constructed from a plurality of plate-shaped dynodes laminated one on another. Each dynode plate has a plurality of electron multiplication through-holes or channels, each for multiplying electrons. The plurality of electron multiplication through-holes are formed in each dynode plate in correspondence with the plurality of openings at the focusing electrode.

An anode unit and an inverting dynode plate are successively disposed below the dynode unit. The inverting dynode plate is for inverting the orbits of electrons multiplied by and emitted from the dynode unit. The anode unit is provided for receiving the electrons supplied from the inverting dynode plate. The anode unit has a plurality of anodes which are located in correspondence with the respective through-holes or channels in the dynode unit.

SUMMARY OF THE INVENTION

It is noted that the photocathode has an area wider than that of the focusing portion of the focusing electrode plate. That is, the photocathode is provided on the internal surface of the faceplate so as to extend not only over the focusing portion but also over a part of the frame portion of the focusing electrode plate. This area of the photocathode, located confronting the frame of the focusing electrode plate, is referred to as an "ineffective area" hereinafter. No opening is formed on the focusing electrode plate at a region corresponding to this ineffective area. No channel is formed in the dynode unit at a region corresponding to this ineffective area. When light falls incident on this ineffective area, photoelectrons will emit from the ineffective area. These photoelectrons should not be guided to any channels of the dynode unit through any openings of the focusing electrode in order to allow the photomultiplier tube to attain a highly accurate position-dependent optical detection.

It is noted, however, that photoelectrons emitted from the ineffective area are largely deflected due to an electric field developed in a space around the frame portion of the focusing electrode plate. The thus deflected photoelectrons will travel through one opening located in the vicinity of the frame portion and will enter the corresponding electron multiplication through-hole in the dynode unit. Accordingly, these photoelectrons will be multiplied and be outputted as undesirable signals.

The present invention is attained to solve the above-described problems. An object of the present invention is therefore to provide an electron multiplier and a photomultiplier tube which will not output undesirable signals due to electrons incident on the frame portion of the focusing electrode plate.

In order to attain the above and other objects, the present invention provides an electron multiplier, comprising: an electron multiplication portion constructed from a plurality of dynode plates laminated one on another, each dynode plate having an edge and a plurality of electron multiplication through-holes for multiplying incident electrons, the plurality of dynode plates including a first stage dynode plate for receiving electrons to be multiplied and a final stage dynode plate for outputting electrons multiplied by the electron multiplication portion; an anode unit for receiving electrons outputted from the final stage dynode plate of the electron multiplication portion; and a focusing electrode plate located in confrontation with the first state dynode plate, the focusing electrode plate having a focusing portion for focusing incident electrons and a frame portion surrounding the focusing portion, the frame portion supporting a plurality of electrodes, the focusing portion having a plurality of channel openings each being defined between a corresponding pair of adjacent electrodes and being located in confrontation with a corresponding electron multiplication through-hole of the first stage dynode plate, the frame portion being formed with at least one dummy opening located in confrontation with the edge of the first stage dynode plate.

According to another aspect, the present invention provides an electron multiplier, comprising: a focusing electrode plate having a focusing portion for focusing incident electrons and a frame portion surrounding the focusing portion, the frame portion supporting a plurality of electrodes, the focusing portion having a plurality of channel openings each being defined between a corresponding pair of adjacent electrodes, the frame portion being formed with at least a dummy opening; an electron multiplication portion constructed from a plurality of dynode plates laminated one on another, each dynode plate having an edge and a plurality of electron multiplication through-holes located in confrontation with the plurality of channel openings, each electron multiplication through-hole being for receiving electrons guided by the corresponding channel opening and for multiplying the received electrons, the plurality of dynode plates including a first stage dynode plate located in a first position of the electron multiplication portion confronting the focusing electrode plate and a final stage dynode plate located in a second position of the electron multiplication portion which is opposite to the first position, the edge of the first stage dynode plate being located in confrontation with the at least one dummy opening; and a plurality of anodes each for receiving electrons emitted from a corresponding through-hole of the final stage dynode plate of the electron multiplication portion.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
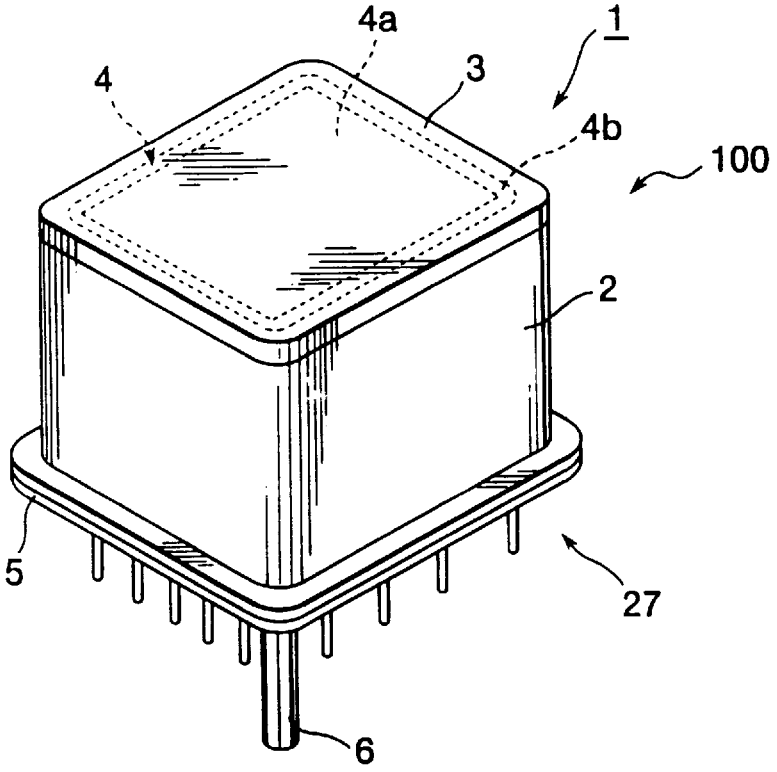
FIG. 1 is a perspective view showing an external view of a photomultiplier tube of a first embodiment of the present invention.

A photomultiplier tube according to preferred embodiments of the present invention will be described while referring to the accompanying drawings wherein like parts and components are designated by the same reference numerals.

Directional terms, such as up and down, will be used in the following description with reference to the state of the photomultiplier tube 1 located in an orientation as shown in FIG. 1.

FIG. 1 is a perspective external view showing a box-shaped photomultiplier tube 1 of the present embodiment. As apparent from the figure, the photomultiplier tube 1 has an evacuated envelope 100 having a generally square-shaped faceplate 3, a generally cylindrical metal sidewall 2 having a square cross-section, and a generally square-shaped stem 5. The square-shaped faceplate 3 is sealingly attached to one open end (upper open end) of the square-cylindrical sidewall 2. That is, the square-shaped faceplate 3 is airtight welded to the upper open end of the square-cylindrical sidewall 2. The faceplate 3 is made of glass. A photocathode 4 is formed on the interior surface of the faceplate 3. The photocathode 4 is for converting incident light into photoelectrons. The stem 5 is sealingly attached to the other open end (lower open end) of the cylindrical sidewall 2.

Figure 2:
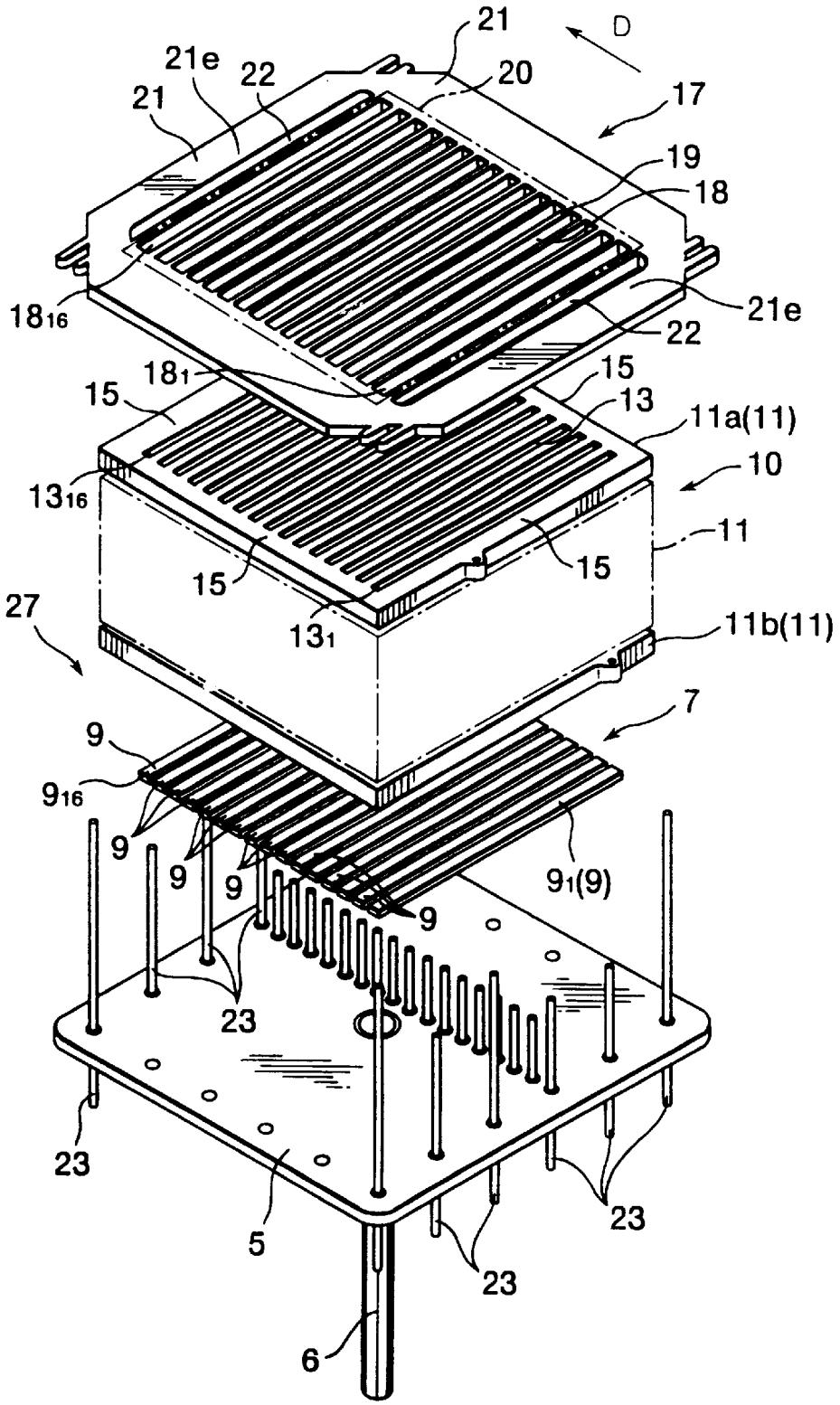
FIG. 2 is an exploded perspective view of an electron multiplier assembly employed in the photomultiplier tube of FIG. 1.

Inside the envelope 100 is provided an electron multiplier assembly 27, shown in FIG. 2, for multiplying the photoelectrons emitted from the photocathode 4.

The multiplier assembly 27 includes: a plate-shaped focusing electrode 17; a block-shaped dynode unit 10; and an anode unit 7. The dynode unit 10 is constructed from eight stages of dynode plates 11 which are arranged as stacked one on another. The dynode unit 10 includes a first stage dynode plate 11*a* at its uppermost position, a second stage dynode plate 11*c* just below the first stage dynode plate 11*a*, and a final stage dynode plate 11*b* at its lowermost position.

The stem 5 is a generally square-shaped metal plate. A metal exhaust tube 6 is provided in the center of the stem 5 to protrude vertically downward. A plurality of stem pins or stem leads 23 are provided also extending vertically through the stem 5 to supply voltages to the multiplier assembly 27. More specifically, the focusing electrode 17, the dynode unit 10, and the anode unit 7 are fixed to the stem 5 via the corresponding stem pins 23. For example, the focusing electrode 17 is connected to four stem pins 23 that are located at the corners of the square stem 5. The stem pins 23 are connected to an electric source (not shown) so that the focusing electrode plate 17, the dynode unit 10, and the anode unit 7 are supplied with predetermined electric voltages. The focusing electrode plate 17, the dynode unit 10, and the anode unit 7 are supplied with the predetermined electric voltages so that the focusing electrode plate 17, the dynode unit 10, and the anode unit 7 have gradually increased potentials toward the anode unit 7. The respective stage dynode plates 11 in the dynode unit 10 are supplied with predetermined voltages so that the dynodes of the respective stages have gradually increased potentials toward the anode unit 7.

It is noted that the stem 5 and the four pins 23 that support the focusing electrode plate 17 are made to have the same electric potential by the electric source (not shown). When the assembly 27 is mounted in the envelope 100, the stem 5 is electrically connected to the sidewall 2. The sidewall 2 is electrically connected to the photocathode 4. Accordingly, when the assembly 27 is mounted in the envelope 100, the photocathode 4 is electrically connected to the focusing electrode plate 17. Thus, the photocathode 4 and the focusing electrode plate 17 have an equal electric potential.

The electron multiplier assembly 27 will be described below in greater detail.

Each stage dynode plate 11 in the dynode unit 10 is electrically conductive and has upper and lower surfaces. The plate 11 is formed with a plurality of, sixteen in this example, through-holes 13 by etching or other means. Each through-hole 13 has a long, rectangular shape. The through-holes 13 are arranged in one-dimensional array along a predetermined direction D. That is, as shown in FIG. 2, first through sixteenth through-holes $\mathbf{13}_1$ through $\mathbf{13}_{16}$ are arranged along the direction D.

Figure 3:
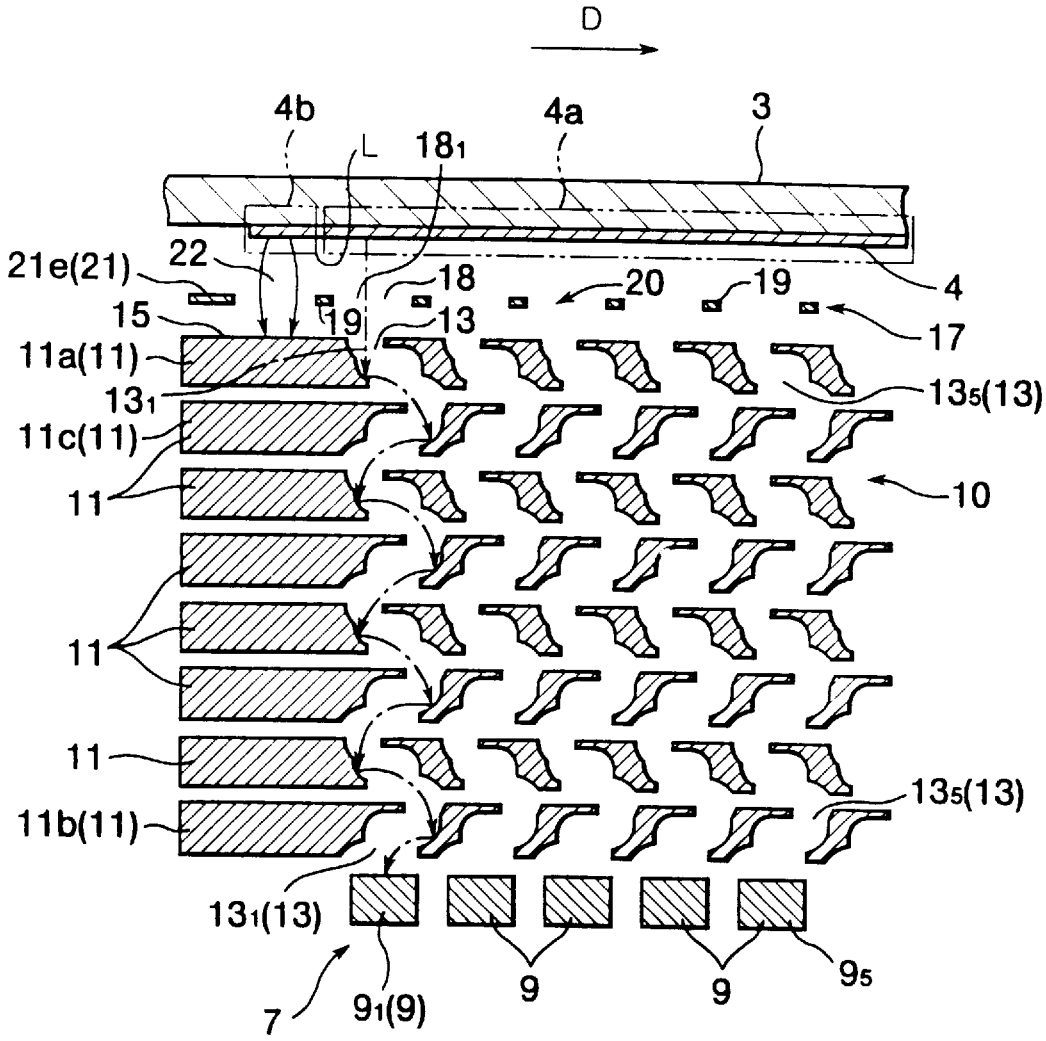
FIG. 3 is a sectional view of the photomultiplier tube of FIG. 1.

The inner surface of each through-hole 13 ($\mathbf{13}_i$ where $1 \leqq i \leqq 16$) is curved and tapered as shown in FIG. 3. Thus, the inner surface of the through-hole 13 is slanted relative to an incidence direction in which electrons enter the through-hole 13 from the photocathode 4. The curved and slanted inner surface of the through-hole 13 is formed with a secondary electron emitting layer made of secondary electron emitting substance such as antimony (Sb) and alkali metal. When electrons entering the through-hole 13 impinge on the inner surface of the through-hole 13, secondary electrons are emitted from the inner surface.

In the dynode unit 10, each dynode plate 11 is laid on its adjacent lower dynode plate 11 in such a manner that secondary electrons emitted from the slanted inner surface of each through-hole 13*i* at each dynode plate 11 will properly enter the corresponding through-hole 13*i* at the adjacent lower dynode plate 11 (where $1 \leqq i \leqq 16$). Thus, each through-hole 13*i* at each dynode plate 11 is located at a position where secondary electrons, emitted from the corresponding through-hole 13*i* at the upper adjacent stage dynode plate 11, can reach.

With the above-described structure of the dynode unit 10, sixteen channels are created by the first through sixteenth through-holes $\mathbf{13}_1$ through $\mathbf{13}_{16}$ in the successively-stacked dynode plates 11. Incident electrons can be multiplied through each of the sixteen channels. That is, when electrons are incident on the first stage dynode plate 11*a* at one through-hole 13, the electrons impinge on the slantedly-curved inner surface of the through-hole 13. Secondary electrons are emitted from the secondary electron emitting layer on the slanted surface. The secondary electrons are then guided by an electric field formed by a potential difference between the first stage dynode plate 11*a* and the second stage dynode plate 11*c*, and fall incident on the second stage dynode plate 11*c* and multiplied there again in the same way. Thus, the flow of incident electrons are multiplied by secondary electron emission through one of the sixteen channels.

The shape of the inner surfaces of the through-holes 13 in each dynode plate 11 is disclosed in U.S. Pat. No. 5,410,211, the disclosure of which is hereby incorporated by reference.

As shown in FIG. 2, each dynode plate 11 has edge portions 15 on its four sides. No through-hole 13 is formed through each of the edges 15. The upper and lower surfaces of each edge portion 15 is coated with no secondary emission substance. For example, each edge portion 15 of the first stage dynode plate 11*a* has an upper surface that confronts the focusing electrode plate 17. This surface extends horizontally and parallel to the focusing electrode plate 17.

As shown in FIG. 1, the photocathode 4 has an effective area 4*a* on its central area. The effective area 4*a* is located in correspondence with the sixteen channels of the dynode unit 10. The photocathode 4 also has an ineffective area 4*b* which surrounds the effective area 4*a*. The ineffective area 4*b* is located in correspondence with the four edge portions 15 of the dynode plate 11*a*. When light is incident on the photocathode 4, the photocathode 4 will emit photoelectrons not only at the effective area 4*a* but also at the ineffective area 4*b*. It is noted that photoelectrons emitted from the effective area 4*a* should be properly multiplied through corresponding channels in the dynode unit 10. However, photoelectrons emitted from the ineffective area 4*b* should not be multiplied through any of the sixteen channels.

As shown in FIGS. 2 and 3, the focusing electrode plate 17 is located above the dynode unit 10 and just below the photocathode 4. The focusing electrode plate 17 has a frame 21 surrounding a focusing portion 20 which is formed from sixteen slit openings 18. The sixteen slit openings 18 are arranged in one-dimensional array along the direction D. That is, first through sixteenth openings $\mathbf{18}_1$ through $\mathbf{18}_{16}$ are arranged in the same direction D in which the channels $\mathbf{13}_1$ through $\mathbf{13}_{16}$ are arranged in the dynode unit 10. As shown in FIG. 3, the focusing portion 20, i.e., the sixteen slit openings 18 are located just below the effective area 4*a* of the photocathode 4. The focusing portion 20 is for focusing photoelectrons emitted from the effective area 4*a* and for guiding the received photoelectrons into one of the sixteen channels $\mathbf{13}_1$ through $\mathbf{13}_{16}$ of the dynode unit 10.

As shown in FIG. 2, a pair of dummy slit openings 22 are formed through the frame 21 at opposite sides along the direction D so that eighteen slit openings are arranged in total along the direction D. The dummy slit openings 22 are located just below the ineffective area 4*b* of the photocathode 4 and just above two opposite edge portions 15, of the first stage dynode plate 11*a*, along the direction D. One of the pair of opposed dummy openings 22 is shown in FIG. 3.

All the eighteen openings 18 and 22 are separated from one another by seventeen electrode strips 19 which are supported to the frame 21. The seventeen electrode strips 19 are arranged in one-dimensional array along the predetermined direction D, that is, in the direction in which the sixteen channel through-holes $\mathbf{13}_1$ through $\mathbf{13}_{16}$ are arranged in each stage dynode plate 11.

Each slit opening 18 is therefore defined as sandwiched between a pair of adjacent electrode strips 19. Each slit opening 18*i* (where $1 \leqq i \leqq 16$) defines a channel which is located in confrontation with a corresponding channel through-hole 13*i* (where $1 \leqq i \leqq 16$) of the dynode unit 10. A pair of adjacent electrode strips 19, sandwiching each slit opening 18 therebetween, serve to electrically guide electrons, that are incident on the subject slit opening 18, into a corresponding through-hole 13 in the first stage dynode plate 11. Thus, a pair of adjacent electrode strips 19, defining each channel opening 18 therebetween, serve to guide photoelectrons from the photocathode effective area 4*a* to a corresponding channel through-hole 13 of the dynode unit 10.

Contrarily, each dummy slit opening 22 is defined between one electrode strip 19 and a remaining edge portion 21*e* of the frame 21. Each dummy slit opening 22 is located in confrontation with the upper surface of a corresponding edge 15 of the first stage dynode 11*a*. Thus, the frame edge 21*e* and one electrode strip 19 adjacent to the frame edge 21*e*, that sandwich therebetween each dummy slit opening 22, serve to electrically guide electrons, that are incident on the subject dummy slit opening 22, to the corresponding edge portion 15 of the first stage dynode plate 11. Thus, the frame edge 21*e* and the adjacent electrode strip 19, defining each dummy slit opening 22 therebetween, serve to guide photoelectrons from the photocathode ineffective area 4*b* to the upper surface of the corresponding edge portion 15 of the first stage dynode 11*a*.

The anode unit 7 is disposed below the final (eighth) stage dynode plate 11*b* of the dynode unit 10. The anode unit 7 is constructed from sixteen elongated anode strips 9, which are electrically insulated from one another. The anode strips 9 are arranged in one-dimensional array in the direction D. That is, first through sixteenth anodes $\mathbf{9}_1$ through $\mathbf{9}_{16}$ are arranged along the same direction D in which the channels $\mathbf{13}_1$ through $\mathbf{13}_{16}$ are arranged. Each anode 9*i* ($1 \leqq i \leqq 16$) is located in confrontation with a corresponding channel 13*i* ($1 \leqq i \leqq 16$) of the final (eighth) stage dynode plate 11*b*. Each anode 9*i* ($1 \leqq i \leqq 16$) can therefore receive electrons multiplied in and emitted from the corresponding channel 13*i* ($1 \leqq i \leqq 16$) of the final (eighth) stage dynode plate 11*b*. Thus, position-dependent light intensity detection can be performed by the sixteen anodes 9. That is, the photomuliplier tube 1 can determine the position where light is incident on the faceplate 3 by determining which leads 23 from the anodes 9 produce the greatest current. Because the current from the leads 23 varies dependent on the amount of incident light, the leads 23 which output the greatest current will be those directly beneath the position where light is incident on the photomultiplier tube 1.

Thus, according to the photomultiplier tube 1, the focusing electrode plate 17 has the focusing portion 20 for focusing incident electrons and the frame 21 surrounding the focusing portion 20. The focusing portion 20 has the plurality of slit openings 18. The dynode unit 10 is constructed from the plurality of dynode plates 11 laminated one on another. Each dynode plate 11 has a plurality of electron through-holes 13 located in confrontation with the plurality of slit openings 18. The plurality of anodes 9 are provided for receiving electrons emitted from the respective through-holes 13 of the dynode unit 10. The frame 21 has dummy openings 22 at positions located in confrontation with the edges 15 of the first stage dynode plate 11*a* in the dynode unit 10.

During manufacture of the photomultiplier tube 1 having the above-described structure, the faceplate 3, with its inner surface being deposited with antimony (Sb), is sealingly attached to an upper open end of the square-cylindrical sidewall 2. Then, the electron multiplier assembly 27 is electrically connected to the stem 5 by the stem leads 23. An inner surface of each through-hole 13 in each dynode plate 13 is already deposited with antimony (Sb). Then, the multiplier assembly 27 and the stem 5 is inserted into the square-cylindrical sidewall 2 through the lower open end. Then, the stem 5 is sealingly attached to the lower open end of the sidewall 2. The tube 6 is then connected to an exhaust system, such as a vacuum pump (not shown), to provide communication between the interior of the photomultiplier tube 1 and the exhaust system. The exhaust system evacuates the envelope 100 via the tube 6. Then, alkali metal vapor is introduced into the envelope 1 through the tube 6. The alkali metal is activated with the antimony on the faceplate 3 to form the photocathode 4. The alkali metal is activated also with the antimony on the inner surface of each through-hole 13 to form the secondary emitting layer. The tube 6 is unnecessary after production of the photomultiplier tube 1 is complete, and so is severed at the final stage of producing the photomultiplier tube 1 through a pinch-off seal or the like.

The manufacturing method is described in detail in U.S. Pat. No. 5,504,386, the disclosure of which is hereby incorporated by reference.

With the above-described structure, the photomultiplier tube 1 operates as described below.

The focusing electrode 17, the dynode unit 10, and the anode 7 are supplied with predetermined electric voltages via the pins 23. When light falls incident on the photocathode 4 via the faceplate 3, the photocathode 4 generates photoelectrons. More specifically, when light falls incident on the effective area 4*a* at a certain position, the effective area 4*a*, at that position, generates photoelectrons, which are then focused by an electron lens effect established between a pair of adjacent electrode strips 19 and 19 that are located beneath the light-incident portion. As a result, the photoelectrons are convergently bombarded to a desired inner surface of a through-hole 13 of the first stage dynode plate 11*a* as indicated by a one-dot-and-one-chain arrow in FIG. 3. The photoelectrons thus enter one through-hole 13 of the first stage dynode 11*a*, and then are multiplied in the multistage of the successive dynodes. The electrons then emit from the through-hole 13 of the final stage dynode 11*b*, and are detected by the corresponding anode 9.

Thus, photoelectrons generated at the photocathode effective area 4*a* are focused by one of the sixteen channel openings $\mathbf{18}_1$ through $\mathbf{18}_{16}$ and are properly guided to the corresponding channel 13*i* ($1 \leqq i \leqq 16$) of the dynode unit 10. The photoelectrons are then multiplied in a cascade manner in the subject channel 13*i* ($1 \leqq i \leqq 16$) and are detected by the anode 9*i* ($1 \leqq i \leqq 16$) at the same channel.

Especially, according to the present embodiment, each of the sixteen channel openings $\mathbf{18}_1$ through $\mathbf{18}_{16}$ is defined between a corresponding pair of adjacent electrode strips 19 and 19. An electron lens effect of the same amount is therefore established in each slit opening 18*i* ($1 \leqq i \leqq 16$). Photoelectrons generated at each of sixteen regions in the effective area 4*a*, which are located above the sixteen channel openings $\mathbf{18}_1$ through $\mathbf{18}_{16}$, are therefore properly focused by a corresponding one of the sixteen slit openings $\mathbf{18}_1$ through $\mathbf{18}_{16}$, and are guided to the corresponding one of the sixteen channel through-holes $\mathbf{13}_1$ through $\mathbf{13}_{16}$ and multiplied thereat. Accordingly, crosstalk can be suppressed among the respective sixteen channel regions in the photocathode effective area 4*a*. Crosstalk can therefore be suppressed among the sixteen anodes $\mathbf{9}_1$ through $\mathbf{9}_{16}$. When light with uniform intensity falls incident over the entire effective area 4*a*, all the anodes $\mathbf{9}_1$ through $\mathbf{9}_{16}$ will properly output signals of the same amounts. Uniformity over the channels is enhanced.

When the light falls incident on the ineffective area 4*b*, on the other hand, the ineffective area 4*b* generates photoelectrons. The photoelectrons are then focused by an electron lens effect established in a dummy opening 22 located beneath the light incident portion. The electron lens effect is developed by the electric potentials of the frame edge 21*e* and one electrode strip 19 that is located adjacent to the frame edge 21*e*. As a result, the photoelectrons are convergently bombarded to the upper surface of the edge portion 15 of the first stage dynode plate 11*a* as indicated by solid arrows in FIG. 3. The photoelectrons thus enter the edge portion 15 of the first stage dynode 11*a*, and are trapped thereat. That is, the photoelectrons are trapped by the edge portion 15 of the first stage dynode 11*a* and are supplied to the electric power source (not shown) via the corresponding pin 23.

Thus, photoelectrons generated at the photocathode ineffective area 4*a* are focused by the dummy slit opening 22 that is located beneath the photoelectron-generating position. The photoelectrons are guided to the edge portion 15 of the first stage dynode plate 11*a* through the dummy opening 22. Accordingly, the photoelectrons will not enter any through-holes 13 through the focusing portion 20. The photoelectrons will not be detected at any anodes 9.

Figure 4:
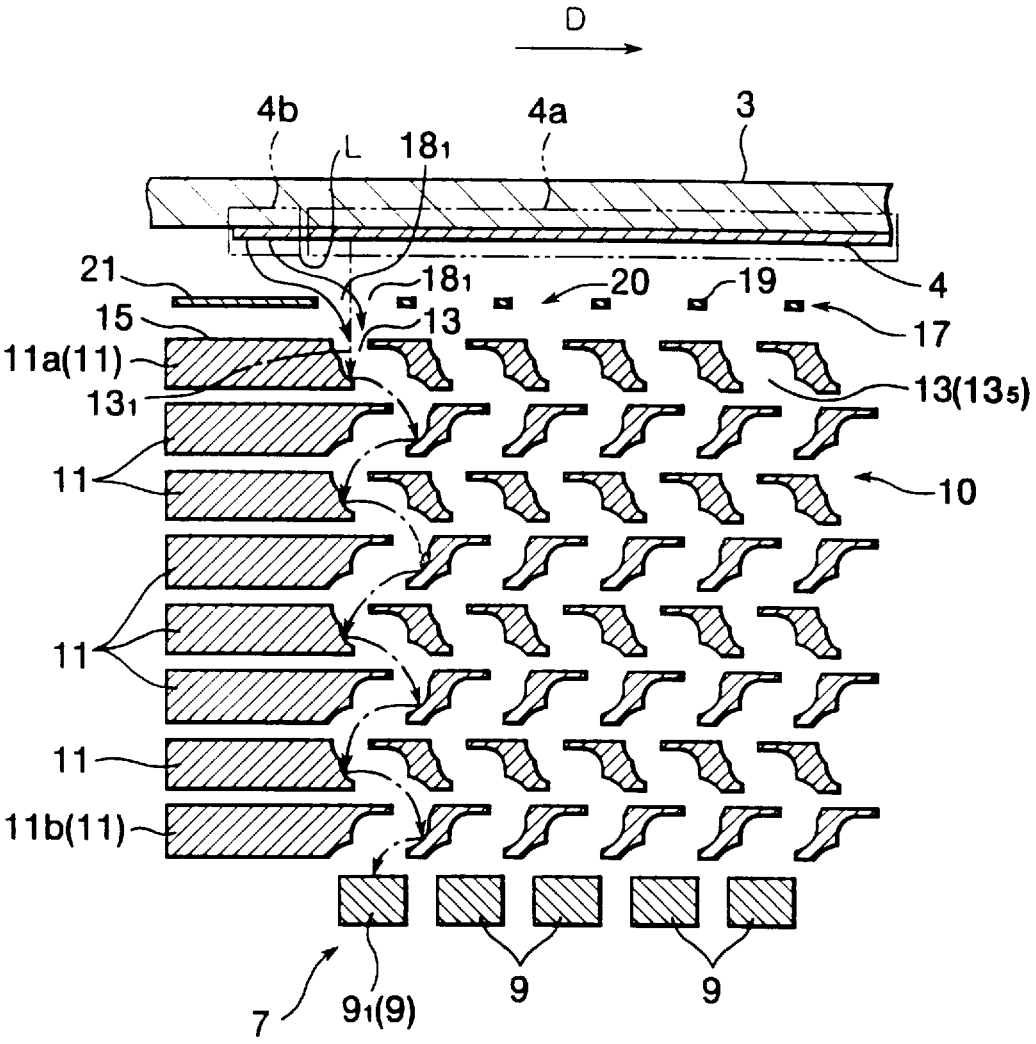
FIG. 4 is a sectional view of a comparative example of a photomultiplier tube whose focusing electrode plate is formed with no dummy openings.

It is noted that if the dummy slit openings 22 are not formed to the frame 21 as shown in FIG. 4, photoelectrons generated at the ineffective area 4*b* are largely deflected by the electric potential of the frame 21 and enter one slit opening 18 that is located closest to the frame 21. It is now assumed that as shown in FIG. 4, photoelectrons are generated at the ineffective area 4*b* closest to the first channel opening $\mathbf{18}_1$. In this case, the photoelectrons are deflected by the frame 21 to the first channel opening $\mathbf{18}_1$ as indicated by solid arrows in the figure. Accordingly, the first channel opening $\mathbf{18}_1$ will receive photoelectrons not only from a corresponding region in the effective area 4*a* but also from the ineffective area 4*b*. The anode $\mathbf{9}_1$ of the first channel will detect photoelectrons both from the corresponding portion in the effective area 4*a* and from the ineffective area 4*b*. The anode $\mathbf{9}_1$ of the first channel will fail to output a signal accurately indicative of intensity of light incident at the corresponding portion in the photocathode 4*a*.

Additionally, in this case, the slit opening $\mathbf{18}_1$ of the first channel is defined between the electrode strip 19 and the frame 21 as shown in FIG. 4. The frame 21 has a quite large amount of area relative to that of each electrode strip 19. Accordingly, the electric field established in a space between the frame 21 and the electrode strip 19 is largely distorted in comparison with that established between two electrode strips 19. A proper electron lens effect is not developed in the slit opening $\mathbf{18}_1$ of the first channel. The slit opening $\mathbf{18}_1$ fails to properly focus photoelectrons, generated at the corresponding portion on the effective area 4*a*, into the through-hole $\mathbf{13}_1$. Accordingly, the anode $\mathbf{9}_1$ at the first channel fails to output a signal accurately indicative of the light intensity at the corresponding portion. Even when light with uniform intensity falls incident over the entire effective area 4*a*, the first channel anode $\mathbf{9}_1$ will fail to output signals of the same amounts with other remaining anodes $\mathbf{9}_2$–$\mathbf{9}_{16}$.

Uniformity over the channels is not attained. Crosstalk occurs between the first anode and other anodes adjacent to the first anode. The same disadvantages as described above are obtained also at the sixteenth channel.

Next will be described how the photomultiplier tube of the present embodiment obtains advantages.

Figure 5:
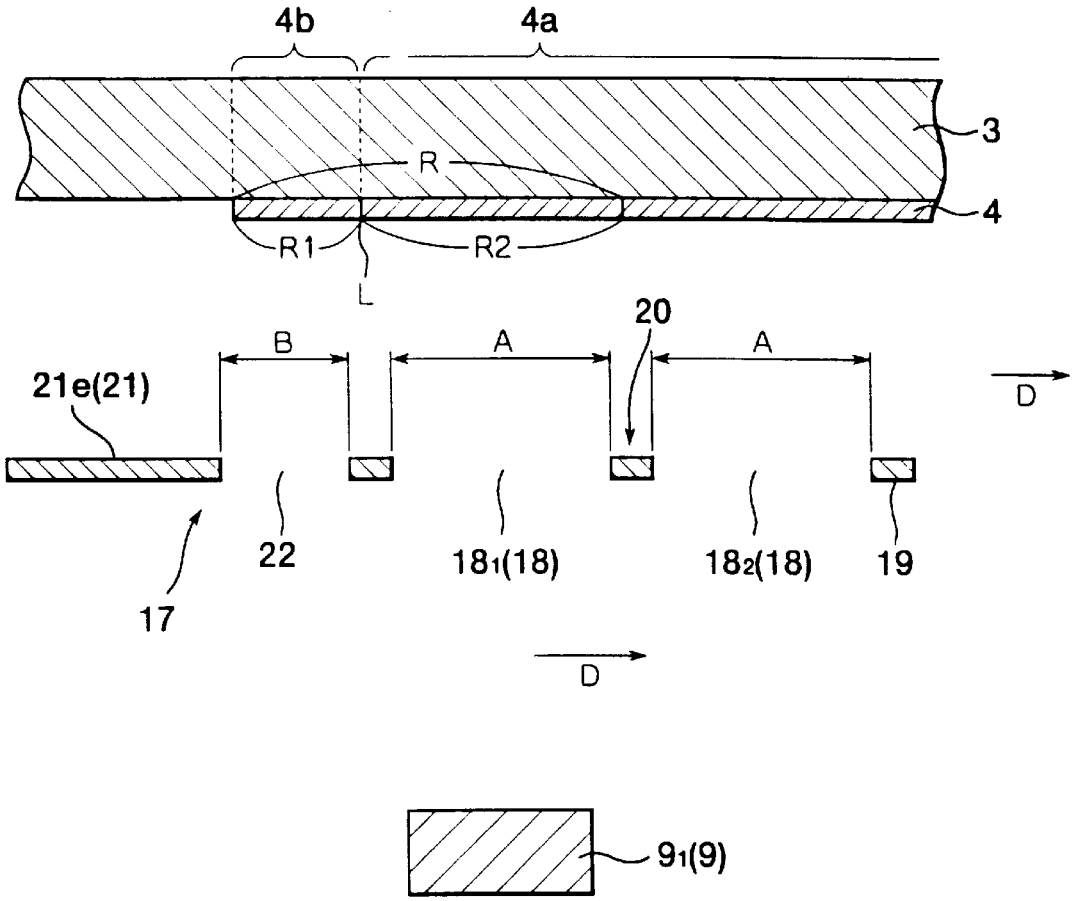
FIG. 5 is a sectional view of the focusing electrode of FIG. 2 showing relationship between the width of the dummy opening 22 and the width of the slit openings 18.
Figure 6A:
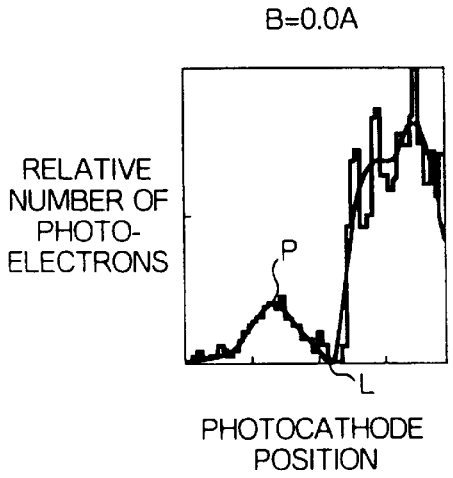
FIGS. 6(*a*)–6(*e*) show graphs indicative of computer simulation results of photoelectron distribution detected by the first anode when the width of the dummy opening is changed.
Figure 6B:
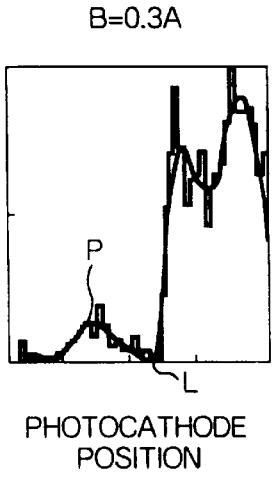
Figure 6C:
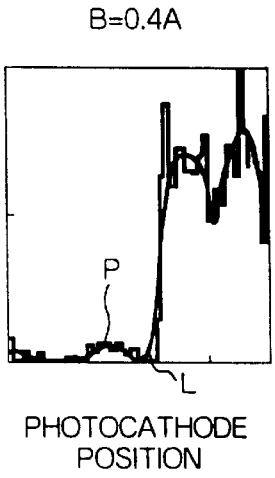
Figure 6D:
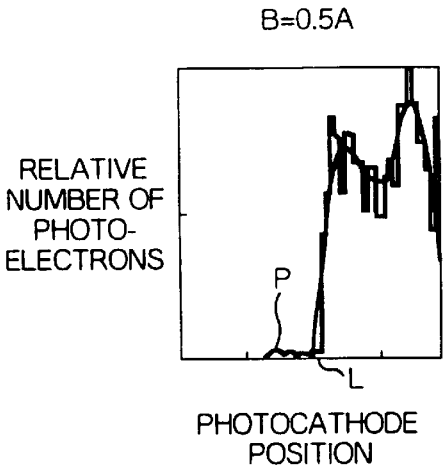
Figure 6E:
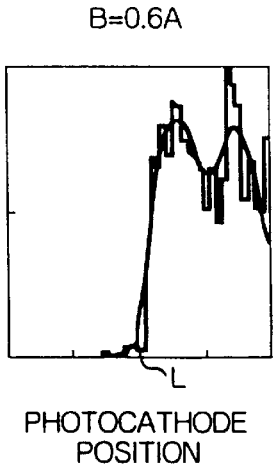

FIG. 5 is a sectional view along the direction D in which the slit openings 18 are arranged in the focusing electrode 17. As apparent from the figure, the thickness of the frame edge 21*e* is equal to that of the electrode strips 19. Each slit opening 18 has a width A along the direction D, while the dummy slit opening 22 has a width B also along the direction D. For example, the width A is 0.82 mm, and each strip 19 has a width of 0.18 mm.

FIGS. 6(*a*) through 6(*e*) show computer simulation results obtained for an area R of the photocathode 4. As shown in FIG. 5, this area R is defined as supplies electrons both to the dummy slit opening 22 and to the first channel slit opening $\mathbf{18}_1$ that is located adjacent to the dummy slit opening 22. This area R is comprised of two areas R1 and R2 which are separated from each other with a border L. The area R1 is located to the left of the border L in the figure and is within the ineffective area 4*b*. The area R2 is located to the right of the border L in the figure and is within the effective area 4*a*. Photoelectrons emitted from the area R1 should not be detected at any anodes 9. Photoelectrons emitted from the area R2 should be detected at the first anode $\mathbf{9}_1$ that is located in correspondence with the slit opening $\mathbf{18}_1$ of the first channel.

Each of the FIGS. 6(*a*) through 6(*e*) shows distribution of the relative number of photoelectrons calculated to be detected at the first channel anode $\mathbf{9}_1$ when photoelectrons are supplied from several points in the area R of the photocathode 4. The several points are defined along a line which extends from the ineffective area 4*b* to the effective area 4*a* in the direction D.

FIGS. 6(*a*) through 6(*e*) are results obtained for several values of the width B of the dummy slit opening 22. In each graph, a horizontal axis denotes an original position of photoelectrons emitted from the photocathode 4, and a vertical axis denotes the relative number of photoelectrons that is calculated as reaches the first channel anode $\mathbf{9}_1$. In the horizontal axis, the reference L denotes the border L between the effective area 4*a* (R1) and the ineffective area 4*b* (R2) on the photocathode 4. Each graph therefore indicates, at a section to the left of the reference L, the degree how photoelectrons emitted from the ineffective area R1 erroneously enter the first channel opening $\mathbf{18}_1$ and are detected at the first anode $\mathbf{9}_1$. At a section to the right of the reference L, on the other hand, each graph indicates the degree how photoelectrons emitted from the effective area R2 properly enter the first channel opening $\mathbf{18}_1$ and are detected at the first anode $\mathbf{9}_1$.

FIG. 6(*a*) indicates the case where the width B of the dummy slit opening 22 satisfies the equation B=0.0 A, that is, no dummy slit opening 22 is formed as shown in FIG. 4. In this case, some parts of the photoelectrons, emitted from the ineffective area R1, are deflected by the electric field established in the space around the frame 21, and are guided to the first channel opening $\mathbf{18}_1$ accordingly. Those photoelectrons are detected at the first channel anode $\mathbf{9}_1$. Accordingly, in FIG. 6(*a*), a high peak appears in the photoelectron distribution in the leftside area of the reference position L. This peak is referred to as "ghost peak P" hereinafter. This ghost peak P is created by photoelectrons originated from the photocathode ineffective area R1, and therefore should be suppressed.

It is additionally noted that in FIG. 6(*a*), the total number of photoelectrons obtained in the rightside section of the reference L is small. In other words, the total number of photoelectrons that are originally emitted from the effective area R2 and that are properly detected at the first anode $\mathbf{9}_1$ are small. This is because the first channel opening $\mathbf{18}_1$ is defined between the frame 21 and the electrode strip 19 as shown in FIG. 4. A proper electron lens effect is not established in the first channel opening $\mathbf{18}_1$ relative to the case where the slit opening $\mathbf{18}_1$ is formed between a pair of electrode strips 19 as shown in FIG. 3. Accordingly, electrons from the area R2 are insufficiently converged to be guided to the first channel through-hole $\mathbf{13}_1$. Some of the photoelectrons are guided to other slit openings 18 adjacent to the first channel opening $\mathbf{18}_1$. Even when light with uniform intensity falls incident over the entire effective area 4*a*, the first channel anode $\mathbf{9}_1$ will fail to output signals of the same amounts with other remaining anodes 9. Uniformity over the channels is deteriorated. Crosstalk between the first channel and other adjacent channels is occurred.

Contrarily, when the dummy slit opening 22 with a certain amount of the width B is provided as shown in FIGS. 6(*b*)–6(*e*), the ghost peak P decreases. The total number of photoelectrons obtained in the rightside section of the reference L increases. As apparent from FIGS. 6(*b*)–6(*d*), the ghost peak P gradually decreases as the ratio B/A increases. The ghost peak finally vanishes when the ratio B/A increases to reach 0.6 as shown in FIG. 6(*e*). Accordingly, no photoelectrons from the ineffective area R1 are detected at the first channel anode $\mathbf{19}_1$. Similarly, the total number of photoelectrons obtained in the rightside section of the reference L gradually increases as the ratio B/A increases. Almost all the photoelectrons emitted from the effective area R2 are properly detected at the first channel anode $\mathbf{19}_1$. Accordingly, the slit opening $\mathbf{18}_1$ of the first channel can properly guide electrons emitted from the corresponding portion on the photocathode 4 to the corresponding anode $\mathbf{9}_1$ in a degree similar to other remaining slit openings $\mathbf{18}_2$–$\mathbf{18}_{16}$. When light with uniform intensity falls incident over the entire effective area 4*a*, the anode $\mathbf{9}_1$ can output signals of almost the same amounts with other remaining anodes $\mathbf{9}_2$–$\mathbf{9}_{16}$. Crosstalk between the first anode and other adjacent anodes can be suppressed.

It is apparent from the above-described computer simulation results that the width B of the dummy slit opening 22 be preferably set to satisfy an inequality $B \geqq 0.6$ A. In this case, almost all the photoelectrons originated from the ineffective area 4*b* are focused into the dummy slit opening 22 and therefore are trapped by the edge portion 15 of the first stage dynode 11*a*. An electron lens effect is properly established in the slit opening $\mathbf{18}_1$ due to the electric potentials at the pair of electrode strips 19 sandwiching the slit opening $\mathbf{18}_1$ therebetween. Almost all of the photoelectrons, originated from the portion R2 corresponding to the first channel, are focused into the through-hole $\mathbf{13}_1$ of the first channel and are successively multiplied before being detected at the first channel anode $\mathbf{9}_1$.

A second embodiment will be described below with reference to FIGS. 7 through 8(*c*).

Figure 7:
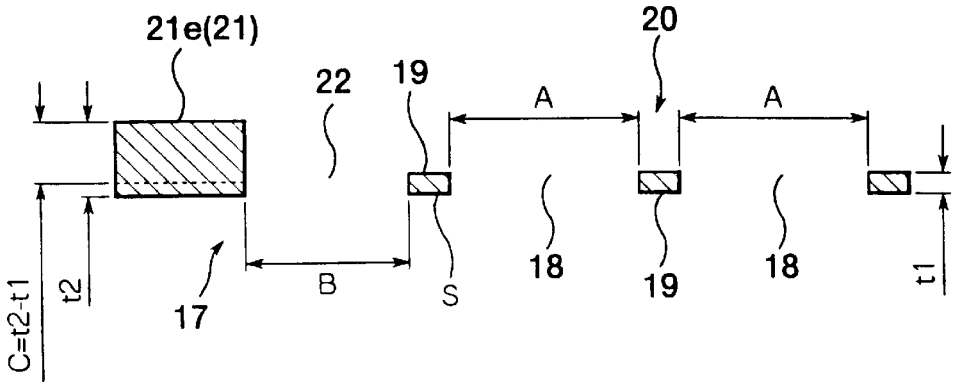
FIG. 7 is a sectional view of the focusing electrode of a second embodiment showing relationship between the width of the dummy opening and the width of the channel openings.

As shown in FIG. 7, according to the focusing electrode plate 17 of the second embodiment, the frame edge 21*e* is made thicker than the electrode strips 19 in the focusing portion 20. Except for this point, the photomultiplier tube 1 of the present embodiment is the same as that of the first embodiment. A portion S shown in FIG. 7 serves as an internal edge of the frame 21 when the frame 21 has no dummy opening 22. The portion S serves also as an electrode strip 19 located adjacent to the frame 21 when the dummy opening 22 is provided. The portion S is designed to have the same thickness as that of the remaining electrode strips 19.

Figure 8A:
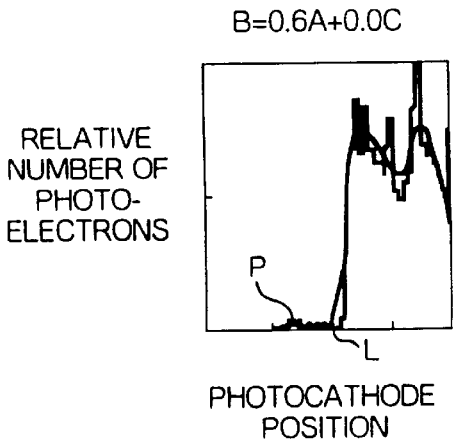
FIGS. 8(*a*)–8(*c*) show graphs indicative of computer simulation results of photoelectron distribution detected by the first anode when the width of the dummy opening is changed in the photomultiplier tube of the second embodiment.
Figure 8B:
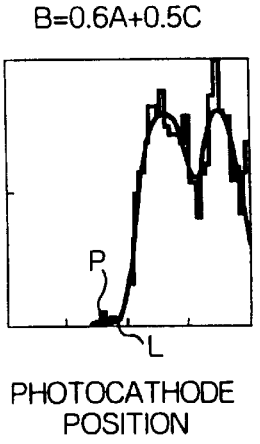
Figure 8C:
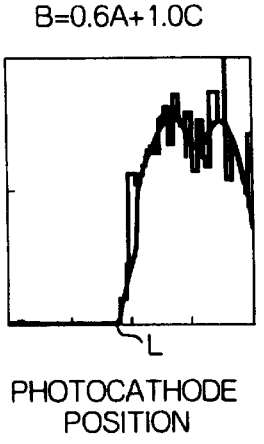

When the frame 21 has a thickness thus greater than that of the electrode strips 19, even when the width B of the dummy opening 22 is set to satisfy the equation B=0.6 A, a small ghost peak P is still detected as shown in FIG. 8(*a*). However, as shown in FIG. 8(*b*), the ghost peak P is suppressed when the width B is set to satisfy the equation B=0.6 A+0.5 C where C is defined as a difference between the thickness t1 of the electrode strips 19 and the thickness t2 of the frame 21. The ghost peak P completely vanishes as shown in FIG. 8(*c*) when B=0.6 A+1.0 C. It is therefore apparent that the width B of the dummy opening 22 preferably satisfies the inequality B≧0.6 A+1.0 C. When the width B satisfies this inequality, photoelectrons generated at the ineffective area 4*b* will be properly focused through the dummy opening 22 onto the edge 15 of the first stage dynode 11*a* and will be trapped thereat. Almost all the photoelectrons emitted from the corresponding first channel area R2 can be properly focused through the first opening $\mathbf{19}_1$ to the first channel and detected at the first anode $\mathbf{9}_1$. Crosstalk between the first channel and other adjacent channels can be suppressed. Uniformity over the respective channels can be enhanced.

While the invention has been described in detail with reference to the specific embodiments thereof, it would be apparent to those skilled in the art that various changes and modifications may be made therein without departing from the spirit of the invention.

Figure 9:
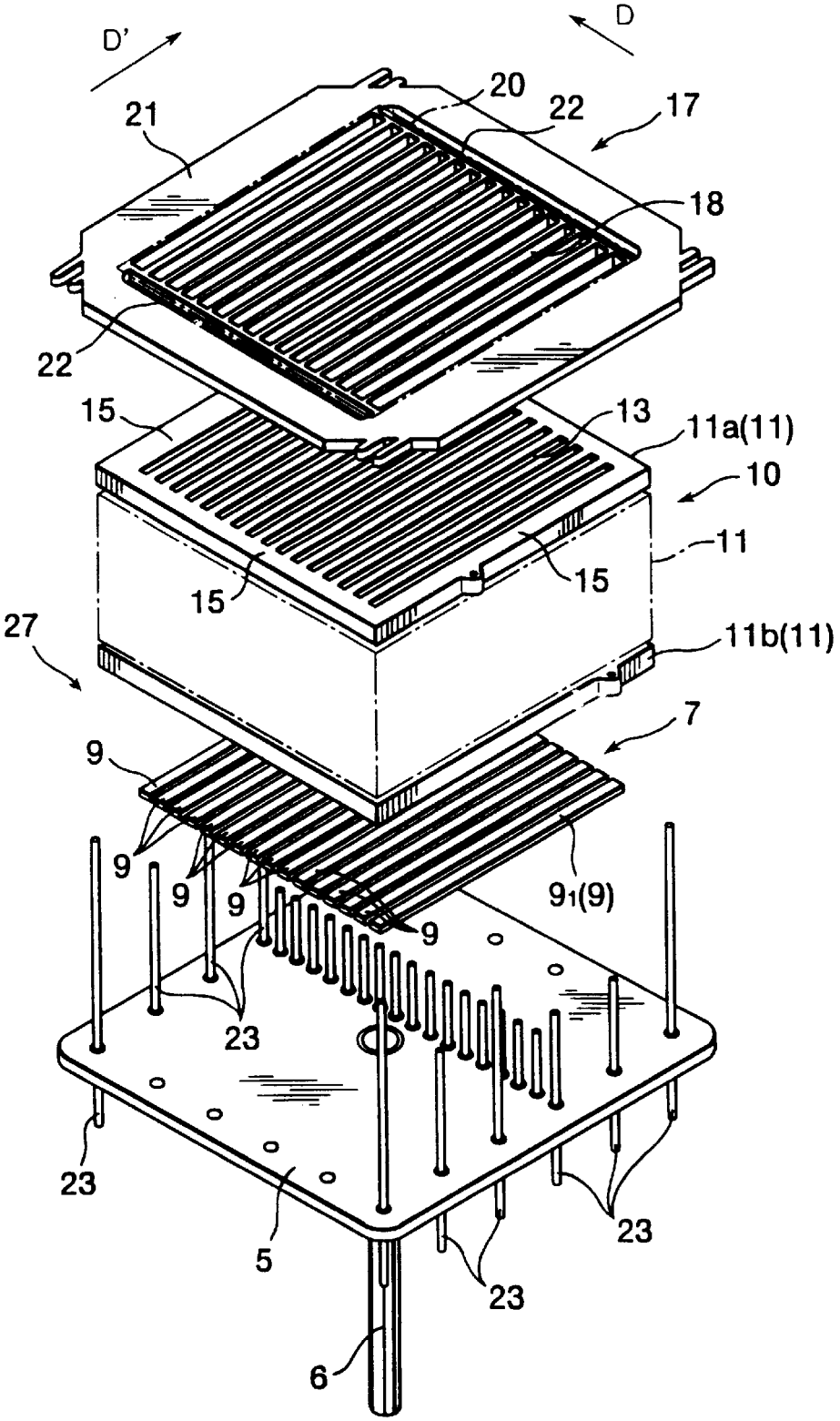
FIG. 9 shows a modification of the focusing electrode plate.

In the above-described embodiments, the dummy openings 22 are formed to the frame 21 at opposite positions along the direction D, in which the slit openings 18 are arranged. However, the dummy openings 22 may be provided to the frame 21 as shown in FIG. 9 at opposite sides along a direction D' which is defined orthogonal to the direction D. Thus provided dummy openings 22 confront the other two edge portions 15 of the first dynode plate 11*a*. The dummy openings 22 can prevent photoelectrons, emitted from opposite end portions in the ineffective area 4*b* along the direction D', from entering any slit openings 18. It is possible to suppress crosstalk between the respective channels 18.

It is noted that four dummy openings 22 can be provided to all the four side edges of the focusing electrode plate 17. Or, only one dummy opening 22 can be provided at one of the four sides of the frame 21.

In the embodiments, the respective channels, that is, the respective slit openings 18 and the respective throughholes 13 are arranged linearly along the direction D. However, the channels may be arranged two-dimensionally in a matrix form. Still in this case, the dummy openings 22 can be provided to the frame 21 as shown in FIG. 2 or FIG. 9. Four dummy openings 22 can be provided in all the four side edges of the focusing electrode plate 17.

The electron multiplier assembly 27 can be used simply as an electron multiplier when the electron multiplier assembly 27 is not assembled in the envelope 100 and is used in a vacuum chamber although not shown in the drawings.

The electron multiplier assembly 27 may be modified into a type provided with an inverting dynode plate.

As described above, according to the electron multiplier of the present invention, at least one dummy opening is provided to the frame at a position confronting the edge of the first stage dynode plate. Electrons, falling incident on the frame, are focused through the dummy opening onto the edge portion of the first stage dynode, and are trapped thereby. Electrons incident on the frame are therefore not multiplied through any channels of the dynode unit, and are not received at any anodes. Accordingly, undesirable signals will not be generated due to electrons falling incident on the frame.

What is claimed is:

1. An electron multiplier, comprising:

an electron multiplication portion constructed from a plurality of dynode plates laminated one on another, each dynode plate having an edge and a plurality of electron multiplication through-holes for multiplying incident electrons, the plurality of dynode plates including a first stage dynode plate for receiving electrons to be multiplied and a final stage dynode plate for outputting electrons multiplied by the electron multiplication portion;

an anode unit for receiving electrons outputted from the final stage dynode plate of the electron multiplication portion; and a focusing electrode plate located in confrontation with the first state dynode plate, the focusing electrode plate having a focusing portion for focusing incident electrons and a frame portion surrounding the focusing portion, the frame portion supporting a plurality of electrodes, the focusing portion having a plurality of channel openings each being defined between a corresponding pair of adjacent electrodes and being located in confrontation with a corresponding electron multiplication through-hole of the first stage dynode plate, the frame portion being formed with at least one dummy opening located in confrontation with the edge of the first stage dynode plate.

2. An electron multiplier as claimed in claim 1, wherein the plurality of channel openings are arranged in a predetermined direction.

3. An electron multiplier as claimed in claim 2, wherein the at least one dummy opening is arranged in the predetermined direction with respect to the channel openings.

4. An electron multiplier as claimed in claim 3, wherein each of the channel openings has a width A in the predetermined direction, in which the channel openings and the at least one dummy opening are arranged, and each of the at least one dummy openings has a width B in the predetermined direction, the widths A and B satisfying an inequality B≧0.6 A.

5. An electron multiplier as claimed in claim 3, wherein each of the channel openings has a width A in the predetermined direction, in which the channel openings and the at least one dummy opening are arranged, and each of the at least one dummy opening has a width B in the predetermined direction, the frame portion having a thickness greater than the plurality of electrodes, a difference C being defined as a difference between the thickness of the frame portion and the thickness of the electrodes, A, B, and C satisfying an inequality B≧0.6 A+1.0 C.

6. An electron multiplier as claimed in claim 2, wherein the at least one dummy opening is arranged in a direction orthogonal to the predetermined direction in which the channel openings are arranged.

7. An electron multiplier as claimed in claim 1, wherein the anode unit includes a plurality of anodes each for receiving electrons outputted from a corresponding electron multiplication through-hole of the final stage dynode plate.

8. An electron multiplier as claimed in claim 1, further comprising:

a sealed envelope for air-sealingly enclosing the focusing electrode plate, the electron multiplication portion, and the anode unit; and a photocathode provided to the sealed envelope at a position confronting the focusing electrode plate.

9. An electron multiplier as claimed in claim 8, wherein the photocathode includes an effective area located in confrontation with the plurality of channel openings and an ineffective area located in confrontation with the frame portion.

10. An electron multiplier, comprising:

a focusing electrode plate having a focusing portion for focusing incident electrons and a frame portion surrounding the focusing portion, the frame portion supporting a plurality of electrodes, the focusing portion having a plurality of channel openings each being defined between a corresponding pair of adjacent electrodes, the frame portion being formed with at least a dummy opening;

an electron multiplication portion constructed from a plurality of dynode plates laminated one on another, each dynode plate having an edge and a plurality of electron multiplication through-holes located in confrontation with the plurality of channel openings, each electron multiplication through-hole being for receiving electrons guided by the corresponding channel opening and for multiplying the received electrons, the plurality of dynode plates including a first stage dynode plate located in a first position of the electron multiplication portion confronting the focusing electrode plate and a final stage dynode plate located in a second position of the electron multiplication portion which is opposite to the first position relative to the electron multiplication portion, the edge of the first stage dynode plate being located in confrontation with the at least one dummy opening; and a plurality of anodes each for receiving electrons emitted from a corresponding through-hole of the final stage dynode plate of the electron multiplication portion.

* * * * *